United States Patent [19]

Wallstén

[11] 4,158,076

[45] Jun. 12, 1979

[54] COATING DELIVERED AS BUBBLES

[75] Inventor: Hans I. Wallstén, Lausanne, Switzerland

[73] Assignee: Inventing S.A., Lausanne, Switzerland

[21] Appl. No.: 865,389

[22] Filed: Dec. 29, 1977

[30] Foreign Application Priority Data

Jan. 3, 1977 [SE] Sweden ..... 7700045

[51] Int. Cl.[2] ..... B05D 1/26

[52] U.S. Cl. ..... 427/294; 118/410; 427/356; 427/445

[58] Field of Search ..... 427/355, 356, 358, 434 C, 427/434 R, 294–297; 118/410, 73, 411, 74; 228/37; 134/102; 162/135, 136, 137, 119, 184, 186, 265, 266

[56] References Cited

U.S. PATENT DOCUMENTS

| | | | |
|---|---|---|---|
| 3,218,193 | 11/1965 | Isaacson | 118/74 X |
| 3,724,418 | 4/1973 | McLain | 118/74 X |
| 4,023,526 | 5/1977 | Ashmus et al. | 118/410 |

*Primary Examiner*—Morris Kaplan

*Attorney, Agent, or Firm*—Lerner, David, Littenberg & Samuel

[57] ABSTRACT

In a method of treating a surface such as a paper web with a treating agent, the treating agent is foamed under pressure and delivered via a passsageway to an application zone so as to come into close proximity with the surface to be treated which may be moved continuously past the application zone. A constriction, upstream in the direction of foam flow, of the passageway causes a pressure drop in the body of the foam causing bubbles of the foam to burst adjacent the surface, being treated whereby the treating agent is applied to the surface.

10 Claims, 5 Drawing Figures

COATING DELIVERED AS BUBBLES

BACKGROUND OF THE INVENTION

The present invention relates to a method of treating surfaces, such as coating moving webs of paper, textile fabrics or rotating rollers, etc., with treating agent, the treating agent being in the form of a foam.

In the paper manufacturing field, for instance, various methods have long been used to give the paper certain desired properties. A coating agent in liquid form, for instance a clay dispersion in water, may be applied on a paper web and then smoothed over the surface of the paper to give the paper better properties than it would have had in its original, untreated state, thus making it more suitable for printing purposes, for example. Another example of a process which has been used for a long time to improve the properties of the paper is surface-sizing to give the surface of the paper a certain strength. This process comprises applying a water solution to one or both sides of the paper, in which solution for instance, a starch has been dissolved. A usual method of application is treatment in a size press consisting of two rollers rotating against each other and pressed together to form a pressure nip. The paper web to be treated is passed through this pressure nip and the starch solution is at the same time applied to both sides of the web before the pressure nip. By a suitable choice of the concentration of the solution and the pressure between the rollers, the amount of solution absorbed by the paper web can be regulated to a certain extent. The paper web, which has become wet during the treatment, is then allowed to pass a suitable drying means so that the water added can evaporate. By means of this process, therefore, the paper has been supplied with a certain quantity of starch and the presence of the water has been necessary in order to ensure homogeneous distribution of the starch in and on the paper web.

Usually only small quantities of the treating agent, for instance starch, are to be applied on the paper web during sizing or other surface treatment whereas liquid, for instance water, must be used in vast quantities. A great deal of water will therefore be absorbed by the paper web thus making the process uneconomic since considerable quantities of energy must be used to remove the water applied.

Only one method has been mentioned by way of introduction for coating moving webs of paper, for instance. There are, however, innumerable other methods and apparatus for surface treating paper, for instance. Instead of the size press described above, coating methods exist in which an excess of coating agent is applied on the paper web by rollers, slots or the like, after which the excess is scraped off by a flexible blade, rotating rod, air brush or the like. For the same reason as stated above in connection with the size press, there is a general endeavour to reduce the quantity of liquid in which the coating agent is dissolved or dispersed in order to save energy and drying equipment in the subsequent drying process. When clay-coating, therefore, that is to say treating a paper web with a coating agent such as clay and a binder dispersed in water, success has recently been achieved in producing a coated paper with a dryness content, i.e. the ratio of dry additives to the total weight of the coating agent, of up to 70 percent by weight. In these cases the weight of coating applied per unit area (calculated as dry) is relatively high. As an example it may be mentioned that clay-coated paper often has a coating of 10-20 gram dry weight per $m^2$.

With respect to surface-treating paper, for instance, by surface-sizing, the desired quantities of dry treating agent are considerably lower. It has been found suitable, for instance, when sizing paper intended for offset printing, to use a quantity of binder in the form of starch or CMC which is less than one gram of dry binder per $m^2$. In some cases a certain amount of binder should penetrate to a certain extent into the paper whereas in other cases only a surface coating is required. In many other cases also where it is desired to influence the function of the paper by surface treatment, the quantities of treating agent are extremely small. It may be a question of surface-colouring or a treatment to alter the barrier properties of the paper by treating it with synthetic polymers or waxes. Other examples include treating with friction-reducing agents or agents giving the paper release-properties and water-treatment of the surface to give the paper a certain moisture content.

In the examples mentioned above, when using conventional coating equipment such as a size press, blade coating means or brush, a solution of dispersion must be used which has an extremely low concentration. The reason for this is that all these known means result in relatively high absorption of liquid in the paper. The amount absorbed naturally also depends on a number of factors other than the equipment used, such as the web speed, the absorption capacity of the paper, surface roughness, etc. However, in general it is desirable to find a method of treating the paper web in which small quantities of liquid are absorbed under controllable conditions.

A method of reducing the quantity of water absorbed has been suggested for surface-sizing and surface-colouring of paper in which the paper web is first given a suitable surface uniformity and then passed over and in direct contact with a gap extending transversely over the web, to which gap the treating liquid is supplied, the entire quantity of liquid being applied on the web. According to this method the paper web completely covers the edges of the gap and no liquid may be permitted to leak outside the edges of the paper. Assuming that the gap, seen in the direction of movement of the web, is not too wide and that the web speed is not too low, the quantity of liquid applied appears to be less dependent on the absorption capacity of the paper and more dependent on the surface roughness of the paper. If the quantity of liquid to be applied is to be low the paper web must be given correspondingly high surface uniformity by means of smoothing, for instance, thus limiting the usefulness of the method since a high surface uniformity is not always desirable for other reasons. In order to obtain uniform coating all over the web, this must be free from uneven longitudinal folds or the like and must be stretched relatively tightly over the gap. This may lead to a risk of rupture in low mass per unit area papers and weak and/or absorbent papers. With high speeds, and especially when using treating liquids with relatively high viscosity, the high hydraulic pressure from the liquid rushing forward tends to lift the paper web from the edge of the gap, resulting in uncontrolled coating. This can only be compensated by still greater paper tension and thus even greater risks of unevenness. Since the liquid must be pumped with a relatively high pressure in order to achieve the requisite flow, a rupture in the web while coating in paper machines entails a risk of considerable mess since the liquid sprays out of the open gap. Furthermore, the method does not permit controlled coating in patches or points which may be desirable in some kinds of coating with very small quantities of coating agent. It is also extremely difficult to adjust a suitable quantity of liquid.

In the cases described above the treating agent is applied so that it covers the entire surface. In some cases this is not necessary or even desirable. This may apply, for instance, when moistening the paper web with water or coating it with friction-reducing agent, for instance for fluting in the manufacture of corrugated cardboard. In order to reduce the quantity of liquid applied, different methods and means are used in some cases so that the treating agent is applied in patches or points on the surface. Such coating methods may comprise spraying or splashing the coating agent in a water solution or water dispersion onto the web with the help of brushes or the like. Another method is to effect coating in patches with the help of engraved rollers. These methods have many disadvantages. Spraying often entails a risk of uneven coating since, particularly with wide webs, many spray nozzles must be placed close together, resulting in difficulties in achieving the desired uniformity. Spraying is also sensitive to draughts which may affect the distribution. Furthermore, spraying of certain treating agents is unsuitable for environmental reasons as there is a risk of the treating agent being spread through the air. The same applies to splashing by means of rotating brushes, for instance. Pointwise coating with engraved rollers is only suitable for narrow webs since larger rollers of this type result in expensive and complicated apparatus.

It has previously been suggested to coat a web of paper or cardboard with a foam produced in known manner and consisting of a liquid in which suitable treating agent has been dissolved or dispersed, and possibly added foaming agent. A foam thus manufactured in known manner is applied on the cardboard web in accordance with the suggestion with the help of a suitable applicator. By afterwards crushing the foam with the aid of a knife or some other mechanical means, a coating is obtained on said web. The advantage with this suggestion may be said to be that a better control of the coating is possible. Coating agents in the form of dispersions must be kept moving in order to prevent settling, which means that it is difficult to check the coating liquid if a rupture occurs in the paper web. One advantage of producing a coating with foam is that if a rupture occurs the supply of foam can easily be stopped by means of a valve and the machine can then easily be started again. Foam can be applied as a coating agent located upstream of a nip formed by two rotating rollers, for instance in a size press or a blade-coating machine. Although certain advantages can be achieved by such known foam-coating methods, it has been found that the liquid absorption when coating with a foam consisting of, for instance, water and size, is as great as with conventional coating methods.

It is clear from the above that there is a need for a method enabling a moving web to be coated with treating agent in a simple arrangement so that the agent is distributed in a controllable manner as uniformly as possible over the surface, while at the same time the quantity of liquid supplied is as small as possible in order to reduce drying costs after the treating process.

BRIEF DESCRIPTION OF THE INVENTION

According to the present invention, there is provided a method of treating a surface with a treating agent comprising the steps of: delivering the treating agent in the form of a foam to an application zone adjacent the surface to be treated; causing bubbles in the application zone and adjacent said surface to burst by causing a pressure drop in the foam at a location upstream of the application zone, whereby said treating agent is applied to said surface; and allowing gas liberated from the burst bubbles to exit through an opening from the application zone.

In an embodiment of the invention the foam is produced under pressure and delivered to an application zone for application of the treating agent to the surface. In the course of being so delivered the body of the foam is caused to undergo a pressure drop, for example by passing the foam along a constricted portion of a passageway. The pressure difference across the membrane of a stable bubble is very small. The foam is produced under pressure and when the pressure on the exteriors of the bubbles is reduced by said pressure drop this increases the pressure difference across the bubble membranes to a high value causing them to burst.

The surface can, e.g., be the surface of a web or sheet of material moved continuously relative to the application zone. The foam is preferably supplied to the application zone in a direction substantially opposite to the direction of movement of the surface to be treated.

To practice the method of the invention, there is provided apparatus for treating a surface with a treating agent in the form of a foam, the apparatus comprising a passageway for delivery of treating agent in the form of a foam, the passageway including means defining an application zone for receiving foam and applying treating agent from the foam to a surface to be treated, means being provided for providing a pressure drop in the passageway upstream of the application zone in the direction of foam flow for causing bubbles in the foam in the application zone to burst adjacent said surface so that treating agent is applied to said surface, and the application zone having an opening for the exit therefrom of gas liberated by bursting of said bubbles.

BRIEF DESCRIPTION OF THE FIGURES

The invention will be further described below with reference to some examples and some embodiments illustrated in the accompanying drawings, in which.

DETAILED DESCRIPTION OF THE INVENTION AND ITS ALTERNATIVE EMBODIMENTS

Figure 1:
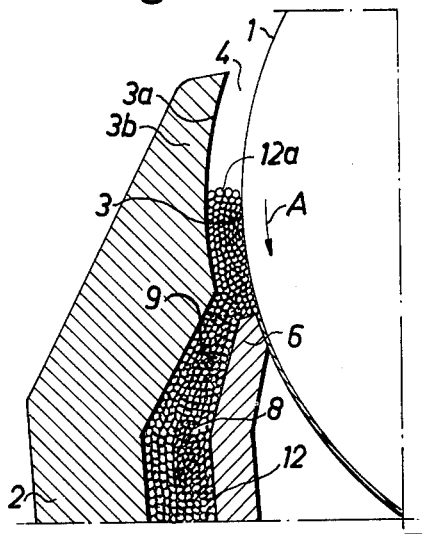
FIG. 1 shows in diagrammatic section a first embodiment of apparatus to practice the present invention.

FIG. 1 shows the effective part, in principle, of an apparatus for coating a moving surface 1 which in this embodiment is the lower surface of a paper web running over a roller rotating in the direction of the arrow A. 2 denotes the upper part of a container defining an inner space 8 which, by way of a restricted passage 9, opens into an application zone 3. The application zone 3 is defined on one side by the web 1 and on the other side by a surface 3*a* of the front end 3*b* of the container 2. A second part of the container 2 forms a sealing edge 6 against the moving web 1 on the inlet side of the zone 3. The opposite, outlet side of the zone 3 is designed as a mouth 4 and is open. 12 denotes a treating agent in the inner space 8 of the container, this being in the form of a foam. In principle the apparatus operates as follows:

The foam treating agent is caused to flow from the inner space 8 of the container 2, through the passage 9 to the application zone 3, its passage through the restricted passage 9 resulting in a pressure drop. Due to said pressure drop the foam is supplied to the paper web 1 so that the foam bubbles 12 nearest the web 1 at least partially burst when they come into contact with the web. In all probability some other foam bubbles are carried on the web 1 and crushed against the edge 6. The reason for the bubbles 12 bursting has not yet been fully clarified and is probably due to several circumstances. Probably the absorption capacity, surface uniformity, degree of protruding fibre ends, etc., all affect the tendency of the foam to burst. Another important factor is the nature of the foam itself. When the bubbles lying closest to the web burst, these are replaced by new foam bubbles at the same time as the gas released when the bubbles 12 burst exits through the opening 4 of the zone 3 because of the prevailing pressure. By adjusting the flow of foam to the application zone 3 in such a way that its content of coating agent corresponds to the quantity of coating agent absorbed by the web 1, the foam will not penetrate further than to a certain limit 12*a* in the zone 3. Under certain conditions the foam in the application zone 3 within the application zone defined at the bottom by the edge 6 and at the top by the limit 12*a* will perform a circular or turbulent movement during application and it is extremely likely that this as well as the prevailing pressure drop contributes to the continuous removal of the gas released when the bubbles burst. The gas is removed through the mouth 4 of the zone 3, thus avoiding the formation of gas pockets which would otherwise result in uneven coating.

With such an embodiment, it is possible in a simple manner to adjust the desired quantity of treating agent which is to be absorbed on the web 1 by a corresponding adjustment of the volume of foam supplied to the zone 3 so that a suitable, corresponding length is obtained for the application zone. The quantity of treating or coating agent can thus be varied within wide limits. If relatively slight absorption on the web 1 is desired, and therefore a small volume of foam is supplied, the limit position 12*a* will be low down in the zone 3 at the lower end of the application zone. If a larger quantity is desired, the quantity of foam supplied to the zone 3 is increased and the limit position of the foam will then lie correspondingly higher in the gap 3. By means of the arrangement shown in FIG. 1, for instance, it is possible in an extremely simple manner to vary the quantity of treating agent applied within extremely wide limits. The quantity of treating agent applied is dependent upon many factors. Extremely small quantities may be applied, for instance, without forming a single, coherent coating layer. In such a case an extremely uniformly distributed pointwise or patchwise coating of the surface is obtained. It is also possible to apply extremely uniform, coherent layers. It has surprisingly been found that, especially if the surface is partially absorbent and consists of paper, for instance, even extremely small quantities of treating agent give a uniform, unbroken treating surface or zone.

Figure 2:
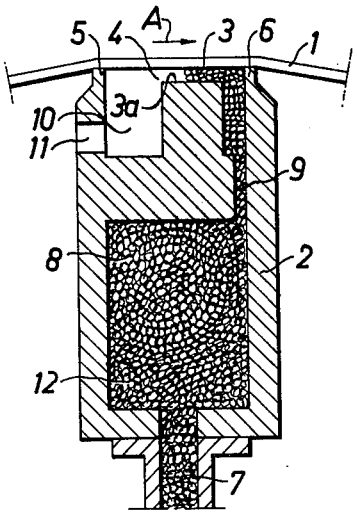
FIG. 2 shows in section a second embodiment of the present invention.

FIG. 2 shows in principle how a moving surface can be coated by means of a different embodiment of the invention. For the sake of simplicity the same reference numerals have been used in this example as in FIG. 1 for equivalent parts. The web 1 is moving in the direction of the arrow A. The apparatus comprises a container 2′ with an application zone 3′ overlying surface 3*a*′. The web 1 is brought into position by two edges 5 and 6′. At the lower part of the container 2 is a supply means 7 for the foamy treating agent. The foam 12 fills the inner space 8′ of the container 2, a restricted passage 9′ leading up to the gap 3′. Seen backwards in the direction of movement of the web, this communicates via the mouth 4′ with a chamber 10 which, by way of one or more outlets 11, communicates with the atmosphere or another container, for instance under vacuum, which is not shown in the Figure.

In FIG. 2 the individual foam bubbles have been designated 12.

A pressure drop is arranged in suitable manner to prevail between the supply means 7, the inner space 8′, the passage 9′, the zone 3′, the mouth 4′, the chamber 10 and the outlet 11. Due to this pressure drop, the foam is fed forward so that the foam bubbles 12 lying nearest the surface of the paper are brought into contact with the web, whereupon at least some of them burst.

The pressure drop can be achieved in several ways. For example, the foam can be supplied to the container 2′ under super-atmospheric pressure and the chamber 10 through the outlet 11 which is in communication with the atmosphere. Another method is for the chamber 10 to be at sub-atmospheric pressure by being connected to a fan or vacuum pump. The most appropriate distribution of the pressure drop during the passage of the foam from the container 2′ to the zone 3′ can be determined by suitable dimensioning of the throttling restriction in the passage 9′ and the gap 3′.

By adjusting the pressure difference in the space 8′ and the chamber 10 with respect to the factors prevailing it is possible in an extremely simple manner to direct a flow of foam bubbles towards the web 1 and by setting the flow volume at a desired value, to obtain a corresponding coating weight per unit area. Several examples will be given later on as to how various coatings have been achieved, these examples also showing how different factors affect the result.

The effect obtained with the above embodiments is extremely suprising. It might be thought, for instance, that the coating is produced solely by the foam accompanying the web and being mechanically crushed against the edge 6′. Although this may well happen to a certain extent it has, however, been found that there is strong reason to assume that the coating is also achieved by bubbles 12 bursting directly upon contact with the web 1. This is confirmed by the following experiments which have been performed. If an apparatus in accordance with FIG. 2 is used and a web of paper, for instance, is held stationary and allowed briefly to come into contact with a quantity of foam by arranging a momentary pressure pulse, the web will become coated with liquid.

By experiment it can be proved that the arrangement of a flow of foam with the aid of a pressure drop through one or more gaps so that the gas liberated can be continuously removed is a necessary condition if a uniformly distributed, controllable and adjustable coating is to be obtained. The experiment is most easily performed with an apparatus according to FIG. 2 by increasing the pressure so that the foam fills the chamber 10 and thus completely fills the opening formed between the walls 5 and 6' and the opposite side walls (not shown). If at the same time the outlet 11 is blocked, an acceptable coating is not obtained on the paper web. In certain cases no coating is obtained at all. If the pressure is increased considerably, the coating is uneven and uncontrollable. The explanation for this is that the gap-shaped space formed between the walls is completely filled with foam and no ventilation is possible since the ventilation passage is also blocked. No flow of foam can therefore be directed against the web unless the pressure is increased so that the proper web is lifted and a passage formed between the web and the edge 5 or 6'. Corresponding experiments performed with foam instead of liquid, using an apparatus appropriate to the method described in the introduction have lead to the same negative results.

The treating agent used can be caused to foam in several different ways. For instance foam can be produced by mixing the treating agent with air in known manner, possibly with the addition of a certain amount of foaming agent. Mixing can be performed by means of mechanical stirring, after which the liquid-air mixture is forced by means of a pump through an arrangement of nozzles suitably throttled to further homogenize the foam. The foam may also be produced by pumping the coating composition into a vortex cleaner and introducing air into the vortex cleaner at the bottom thereof. The air supply can be regulated by a valve so that the desired air content can be obtained in the foam.

It has been found to be important to adjust the dimensioning of passages and gaps to the conditions prevailing during coating so that a continuous flow of foam is obtained with a flow rate adjusted to the conditions, particularly in the passage 9' and zone 3'.

Figure 3:
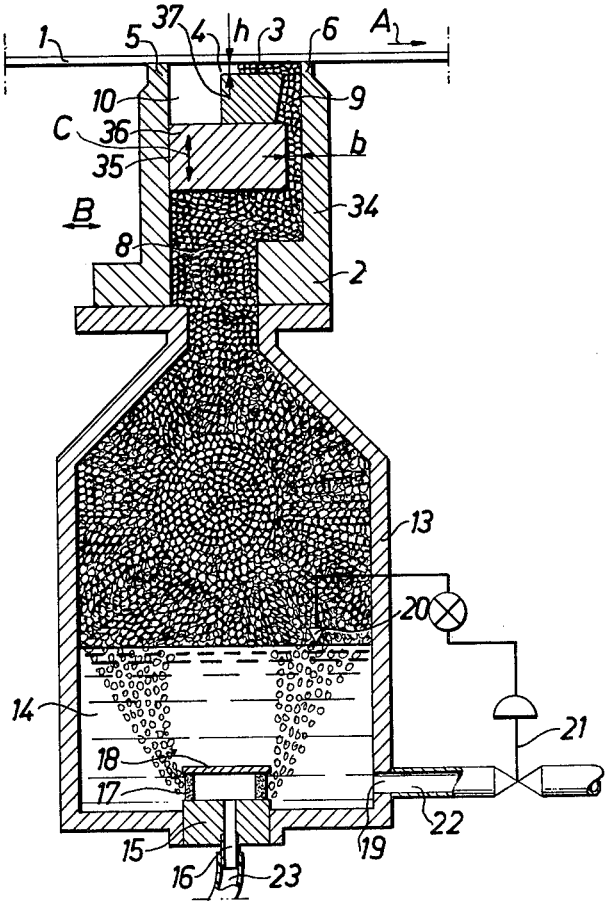
FIG. 3 shows in section a third embodiment of apparatus to practice the present invention.

FIG. 3 shows an apparatus comprising both a coating unit, in operating principle the same as that shown in FIG. 2, and a foam-generator. The coating unit consists of the container 2, composed of various parts which are partly movable in relation to each other to permit the desired adjustability in the width of the passage and zone. The container 2'' thus has a stationary wall 34 forming the edge or strip 6'' at the top. On the opposite side is a movable container wall 35 which, by suitable means, can be moved horizontally to and fro in the direction of the arrow B. At the top the wall forms the spacer 5''. Along the movable wall 35 is a an insert 36, movable in the vertical direction as shown by the arrow C. A strip 37, movable in the horizontal direction, is placed on the insert 36. The distance between the paper web 6 and the upper, horizontal part of the strip 37 has been designated h. The distance between the vertical part of the insert 36 facing the stationary wall 34 and the stationary wall 34 has been designated b.

The distances b and h can be adjusted as desired with the help of the adjustable coating means shown in FIG. 3 in a simple manner, possibly while coating is in progress.

It is easily understood that this can be performed with the apparatus described by displacing the movable parts in relation to each other. For example, the distance b can be altered by displacing the wall 35 horizontally without simultaneously affecting the distance h. In the same way the distance h can be altered by displacing the insert 36 in the vertical direction. This can be performed without the distance b being affected at the same time. The above is only one example of how, with simple devices, the requisite adjustability can be achieved in order to effect a continuous flow by suitable throttling of the foam on its way to the web. The length of the zone 3'' seen in the direction of movement of the web 1 is also of significance. In certain cases it has been found advisable to use a relatively long distance. This is particularly so when relatively large quantities of coating agent are desired or if it is to be ensured that, in spite of variations in the foam flow, no excess of foam is able to pass the gap and penetrate out into the chamber 10''.

As mentioned above, the apparatus of FIG. 3 also includes a foam-producing means which is attached to the bottom of the coating unit. It has been found that such a combined unit has many advantages. It can be made extremely compact, for instance, and is simple in design.

The foam-producing means comprises a container 13. At the bottom of the container 13 is a coating agent 14 in liquid form. The coating agent is to be a certain level in the container 13 and there is preferably also a foam generator 15 comprising an inlet for air 16 and an annular, porous piece of material 17 covered by a lid 18. The coating liquid is supplied to the container 13 through a supply conduit 19. The level of the coating liquid in the container 13 can be kept constant by suitable control equipment consisting of a level monitor 20 controlling a valve 21 on the supply tube 22. Other conventional methods of maintaining the level in the container are of course also feasible, such as a communicating vessel with overflow in the bottom of the container.

When air or some other gas is supplied in a suitable quantity to the foam generator through the conduit 23, the gas forms small gas bubbles upon passage through the porous wall 17. A foam is thus produced, which rises up through the surface of the liquid and fills the spaces above the surface of the liquid to distribute and supply foam to the coating unit.

The foam generator shown in FIG. 3 may of course be designed in many different ways. For instance it may be constructed substantially in one piece along the entire bottom of the box-like foam-producing means which in this case must be of the same length as the width of the web to be treated. The foam generator 15 may also consist of several units distributed uniformly in a suitable manner along the length of the container 13. In certain cases it has been found advisable for the container 13 with its generator 15 to be divided into sections along its length. It is then possible to individually regulate the quantity of coating agent not only in the longitudinal direction of the web 1 but also transversely across the web 1, by individually setting the coating quantity in each section by corresponding regulation of the quantity of air. It has been found that a means such as that described with reference to FIG. 3 can be made very cheaply and compactly. The container can at the same time act as support for the coating unit which can therefore be made extremely robust without becoming too big and clumsy for wide webs of material, for instance.

Since the foam is generated in the immediate vicinity of the coating means there is less risk of it losing its homogeneity, i.e. of it consisting of bubbles of different sizes. It has been found that a foam which is not homogeneous may in some cases result in uneven coating.

The nature of the foam can be varied within wide limits with the means shown. By selecting a suitable porosity of the porous wall, the liquid level in the container 13 and the height from the surface of the liquid up to the coating unit the nature of the foam can be influenced. One way of judging the nature of the foam is to measure its volume in relation to the volume of the original liquid. A certain amount of liquid will run off the surface of the foam bubles forming in an apparatus according to FIG. 3 where the foam rises from the bottom up through a container, and return to the treating liquid in the bottom of the container. A relatively "dry" foam can thus be obtained. By adjusting the various factors affecting the nature of the foam, its properties such as volumetric weight and bubble size can easily be set.

In the apparatus of FIG. 3 the gas, for instance air, supplied to the foaming means 15 serves not only to produce the foam but also, due to the pressurisation of the air, to transport the foam due through the apparatus.

By varying the quantity of gas, therefore, under otherwise equivalent conditions, a desired quantity of foam can be set, corresponding to the desired quantity of coating.

The embodiments shown in FIGS. 1, 2 and 3 constitute only examples of how the invention can be applied. It has been mentioned in FIG. 1, for instance, that the quantity of foam shall be adjusted to the quantity of liquid it is desired to apply on the web. In certain cases, however, it may be advisable to increase the quantity of foam so that the quantity of foam supplied is greater than is absorbed by the web. In this case, with an apparatus according to FIG. 2, the chamber 10 will be partly filled with foam and air from the bubbles which burst. This excess of foam can be removed through suitable channels and possibly returned for recycling.

Figure 4:
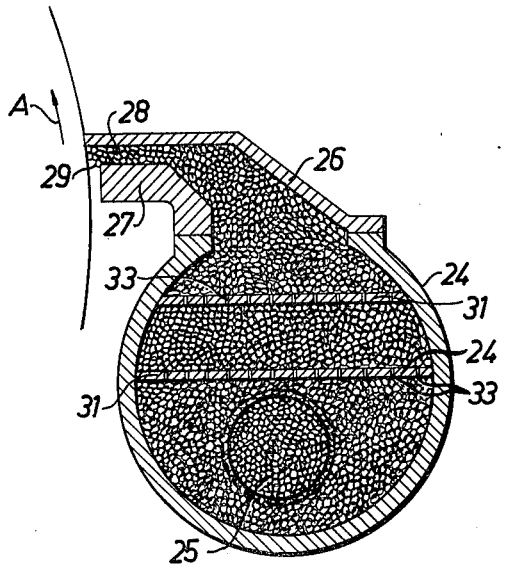
FIG. 4 shows in section a fourth embodiment of apparatus to practice the present invention.

FIG. 4 shows another embodiment of the invention. Foam from a foaming means, not shown, is led through a supply conduit 25 to a tubular container 24. At the upper part of the tube are walls 26 and 27. The walls surround a foam-coating means consisting of passage 28 and gap 29. The surface 30 to be coated may be a roller surface or a web or paper of textile passing over a roller vertically upwards in this case. The gap 29 is open to the atmosphere. One or more plates 31 are located in the tubular container 24. The plates are provided with passages for foam 33, for instance in the form of perforations. The perforated plates serve to homogenise and distribute the foam before it is supplied to the coating means. As can be seen, the apparatus is extremely compact.

Figure 5:
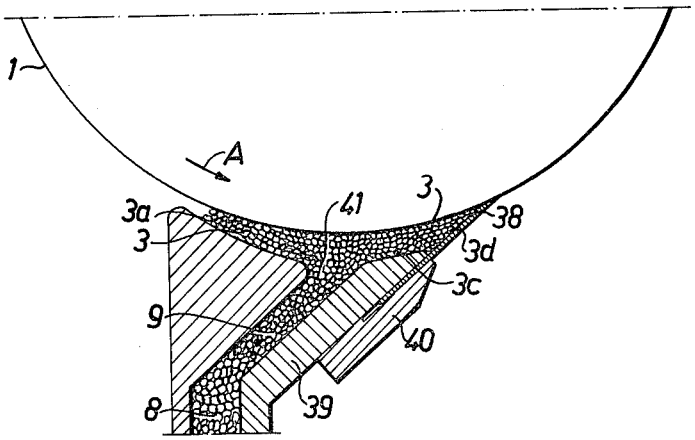
FIG. 5 shows in section a fifth embodiment of apparatus to practice the present invention.

FIG. 5 shows yet another embodiment similar to that shown in FIG. 1. Here the movable surface 1 moves in the direction of the arrow A. The foamy treating agent is applied in this case too by being forced under a pressure drop to flow from the inner space 8''' through the passage 9''' to the application zone 3''' formed between the movable part 1 and the surface **3*a*.''' The edge sealing against the moving surface 1 consists of a flexible strip, such as a strip of flexible steel 38. The strip 38 is secured in a holder consisting, for instance, of two collet jaws 39 and 40, so that it can be replaced when necessary. The upper part of the collet jaw 39 forms the surface 3*c* which, together with the upper, inner surface 3*d* of the strip 38 and the surface 1, also forms part of the application zone 3.''' As can be seen, in this case the foam is not supplied to the last part of the application zone 3''' seen in the direction of movement of the web, but instead through an inlet 41 arranged at a distance from the strip 38**. One advantage of the embodiment shown is that the wiping-off strip is replaceable and flexible. Its flexibility enables any defects in the web to pass, the strip being raised. It is an advantage to be able to renew the strip if it is subjected to wear.

Since, as mentioned earlier, the length of the application zone affects the quantity of treating agent applied under otherwise equivalent conditions, a means where the treating agent is supplied towards the middle of the zone is more suitable for flat coatings.

If extremely small quantities of coating agent are desired, not covering the entire surface, the foam should be applied towards the downstream (in the sense of movement of the web) part of the gap.

As mentioned, it has been emphasized that embodiments of the invention have been found particularly suitable for treating moving webs or surfaces in order to effect extreme coating quantities. Some examples of how the method has been tested follow:

EXAMPLE 1

An apparatus similar to that shown in FIG. 3 was used to coat an unsized, wood-containing, machine-smoothed printing paper in a mass per unit area of 60 $g/m^2$ with water. The paper web was transported at a speed of around 50 m/min. The distance h (see FIG. 3) was 2 mm, the distance b 2.5 mm. The length of the zone 3 measured in the direction of movement of the web was 20 mm. The water was brought to foam by the addition of 0.1 parts by weight of a surface-active foaming agent, producing a volume of about 50 times the original volume of the liquid. The air supplied had a pressure of 5 m $H_2O$ before the foaming means and the quantity of air through the filter was about 2.5 normal liters (Nl) per minute/meter web width/side. It was found that by altering the quantity of air supplied, which was done by adjusting a value connected to a flow meter, the coating quantity could be adjusted with great accuracy and reproducibility. Thus, a coating quantity of around 2 $g/m^2$ was obtained as an extremely even, coherent coating layer with a quantity of air of 3.5 Nl/min. In this case the quality of the coating layer was judged by the addition of colour to the liquid. The coating quantity required for a coherent coating of this quality of paper, which has an extremely high absorption capacity, must be considered remarkably low at this speed. In a corresponding experiment with roller application of unfoamed liquid in a size press with the same quality of paper and under otherwise similar conditions, a coating quantity of about 15 g/side was obtained. It was also found, which must be considered extremely important, that with the embodiment of the invention, the coating quantity could be reduced to a very low value with good reproducibility. Thus in a series of experiments, for instance, a coating quantity of ca. 0.3 $g/m^2$ was obtained. The overpressure on the air supplied was 3 m $H_2O$ and the quantity of air ca. 1.5 Nl/min. In this case the surface of the paper was not wholly covered but the coating had extremely uniform distribution in the form of an extremely delicate pattern. By adding optical brightener to the coating liquid the coating result could also be studied using ultraviolet light instead of studying the results of colouring matter in the liquid. It was found, for instance, that with extremely small coating quantities, small circles could be observed, partly covering each other, these being interpreted as being the circles formed by the burst bubbles.

It was noticeable that the surface within the periphery of these circles often appeared to be covered with a thin layer of coating liquid, indicating that when the bubble bursts the walls are not drawn together to one drop but form a thin membrane which is absorbed by the surface of the paper. This observation does not apply only to the series of experiments described above, but could be observed on most surfaces when coating with very small quantities of coating agent.

EXAMPLE 2

Experiments were performed with a sized Mg-kraft paper in a mass per unit area of 40 g. The paper is characterised in that the Mg-side is extremely smooth whereas the other side has relatively high surface roughness. The same apparatus as in Example 1 was used. The coating agent was water with the addition of foaming agent. In the experiments coating was performed at high speeds as well as at low speeds. It was found in this case that it was possible by regulating the quantity of foam, to achieve a coherent coating on this paper even with very small coating quantities and low speeds. On the smooth side of the paper a coating quantity of 0.6 g/m$^2$ was measured and on the rough side 1.5 g/m$^2$. These values must be considered as extremely low. Corresponding experiments in accordance with the zone method using an unfoamed liquid required considerably greater coating quantities. On the smooth side a quantity of 4 g/m$^2$ was measured and on the rough surface 10 g/m$^2$.

EXAMPLE 3

An apparatus similar to that shown in FIG. 3 was used to treat fluting paper with the addition of a lubricant in the form of a stearate in accordance with the addition of a lubricant in the form of a stearate in accordance with Swedish patent application No. 74 08 126-6. In this case the fluting paper was treated on both sides simultaneously with a dispersion of the stearate. The mentioned Swedish patent application relates to the addition of minute quantities of stearate to the surface of fluting paper. This reduces the surface friction when the fluting paper is pressed between the ridges in a corrugated cardboard machine in order to be fluted. This is important since, thanks to the addition of lubricant, fluting can be used with a base of cheap waste with the risk of ruptures at full production rate in the manufacture of corrugated cardboard. However, since the lubricant is extremely expensive, it must be possible to add this in small, well-regulated quantities. Spraying through nozzles has previously been tried. However, this has the drawback that the coating is uneven since the nozzles sometimes become clogged and also that dust particles fly around in the air around the machine, which is unacceptable from the environmental point of view.

By use of an embodiment of the present invention, the corrugated cardboard machine could run at full production rate with the desired coating of 0.02 g/m$^2$ per side of the lubricant. This was achieved by preparing a 2% water dispersion and setting a coating quantity—calculated in wet state—of 1 g/m$^2$ per side. No foaming agent was necessary since the lubricant in itself contains foam-producing substances. In this case the dryness content of the water solution was chosen so that the desired quantity of dry lubricant would be obtained on the paper web at the same time as the quantity of water absorbed by the web would give the increase in moisture content from about 7% to 10–12% which is usually desired in the manufacture of cardboard. In this case, therefore, the apparatus also served as moisturizer for the cardboard machine.

EXAMPLE 4

An apparatus corresponding to that shown in FIG. 2 was used. The desired drop in pressure was obtained by the chamber 10 being connected to a fan giving a desired, adjustable sub atmospheric pressure so that the desired flow volume for the foam could be obtained. A 20% solution was prepared of a water solution of a modified starch. A small quantity of foaming agent was added. A wood-free, unsized printing paper was coated with the foamy size solution so that a coherent coating was obtained. The total quantity of wet size solution applied was 3 g/m$^2$ per side. The total quantity of water applied was thus only 2.4 g water per m$^2$ and side. After drying the paper sized on both sides in this way was found to have good resistance to picking. The experiment shows that, with very simple apparatus requiring little space, for instance directly in the paper machine, it is possible to perform surface-sizing, for instance, and that the water added is very little, thus enabling a vast saving in energy. Furthermore, no special arrangements need be made for drying the paper in such cases.

EXAMPLE 5

An unsized newspaper weighing 40 g/m$^2$ was treated on both sides by means of two devices similar to that shown in FIG. 2, placed opposite each other. The treating agent consists of a foamy pigment dispersion consisting of coating clay dispersed in water to which were also added binder, dispersing agent and foaming agent. The dryness content of the dispersion was 40 percent by weight and the binder consists of starch having a binder content of 20 percent of weight calculated on the weight of dry pigment. Before foaming the dispersion had a viscosity of about 200 centipois measured with a Bookfield viscosity meter. The application quantity was set so that good flat coverage of the pigment dispersion was obtained. A series of different experiments was performed in which an application quantity of 5 g dispersion/m$^2$ per side was set. This corresponds to about 2 g/m$^2$ per side dry pigment and binder and 3 g water/m$^2$ per side. A total of 6 g water was thus applied on the paper, corresponding to an increase in moisture content of about 12%. Since the paper originally had a certain moisture content, the total moisture content after the treatment was estimated to be about 16%. Considerable advantages have thus be gained since an improvement has been obtained in the printing properties of the paper by the use of an extremely compact and simple apparatus with a reasonable increase in dryness content. Since the quantity of water added to the paper is small, the risk of rupture caused by the treatment is eliminated, as well as the drying equipment needed after the treatment needing only to be minor. The embodiments of the invention can be particularly suitable for extremely wide and/or fast running paper machines.

The Examples given above serve only to indicate certain values of variables in embodiments of the invention in only a few typical cases of application. However, embodiments of the invention can be utilized with values deviating greatly from those in the Examples. For instance, it may be mentioned that the values for h and b stated in Example 1 and the zone length may be totally different in other applications. The value b, for instance, has been set from 0.5 mm up to 30 mm. The distance h has also varied between 0.4 and 6 mm. The values stated here, however, are not limit values and may be exceeded in either direction in certain cases. The important thing is, as is clear from the above, that the values of b and h are in a certain ratio to each other in order to obtain a continuous, uniform flow of foam. The length of the zone 3' according to FIG. 2 measured in the direction of movement of the web may also be varied within wide limits. Values between 5 and 150 mm have been tried, for instance, large application zone lengths being suitable for high speeds and/or relatively large coating quantities. As has been mentioned earlier, the nature of the foam affects the result. One factor of importance is the foaming degree, i.e. the volume of the foam in relation to the volume of the original liquid before foaming. In order to obtain extremely low coating quantities it is a general rule that the foaming degree is high. In one of the Examples above it is stated that a foaming degree of 50 times the original volume was used and it may be mentioned that for coating paper or textile, for instance, with a liquid, the coating quantity being less than 5 g/m$^2$, a foaming degree of at least 20 times the original volume would seem to be suitable. For extremely low coating quantities within the range below 1 g/m$^2$, a foaming degree of 50–200 times would probably be preferable.

The Examples given above are intended to serve to exemplify some fields of application of embodiments of the present invention.

Cardboard and paper have, for instance, been coated in a simple manner with controllable quantities of wax emulsions, colour solutions, surface-sized with starch and CMC.

It has also been possible in a simple manner to moisten paper webs in order to increase the moisture content to a desired value. Experiments have also been made in coating roller surfaces with lubricants. Many other fields of application are, however, feasible within the scope of the invention as defined in the appended claims.

The treating agent may consist of solid particles dispersed in a liquid which is then formed. Other treating agents may consist of agents dissolved in a liquid. A third group may consist only of a liquid or liquid mixture which is foamed.

It has been found that embodiments of the invention have great advantages over previously known methods of surface-treating moving webs. For instance, it has been found that with some embodiments of the invention an extremely compact apparatus can be obtained which is inexpensive in acquisition and easy to supervise. In the event of a rupture the air or foam supply can easily be shut off without risk of mess. The device is thus extremely suitable for building into paper machines, super-calenders or corrugated cardboard machines.

In view of the remarkably small quantities of liquid used, great savings can be made in drying costs in the form of energy and drying equipment.

Since the foam is supplied under a very low excess pressure and does not give rise to large hydraulic forces even at very high speeds, the web need not have been drawn tightly over the coating means. Even thin, unsized paper can therefore be handled without risk of web ruptures.

Neither is there any risk of streaks with uneven coating caused by high web tension in the direction of movement of the web. The coating quantities can easily, and with good reproducibility, be varied within wide limits from total coating with relatively low liquid absorption, to patchwise coating with extraordinarily low liquid absorption. The coating quantity can be controlled in a simple manner by arranging suitable members to influence the pressure drop. In this way, for instance, variation in the coating quantity can be kept within reasonable limits irrespective of web speed, by controlling by means of impulses standing in relation to the web speed or by a moisture content or mass per unit area meter to keep the coating quantity constant.

There are of course numerous variations which may be made in embodiments of the apparatus. The wiping edge 6, 6' and 6'', for instance, may be designed so that it can easily be replaced when worn. It may comprise a thin strip, a flexible steel blade, or a strip of crude rubber.

If both sides of a web are to be coated, two apparatuses can be arranged opposite each other, possibly displaced in relation to each other in the direction of movement of the web, so that simultaneous coating of both sides is obtained.

It has already been mentioned that embodiments of the method according to the invention are suitable for treating surfaces of paper or cardboard, textile webs or roller surfaces. However, the invention is not limited to these fields of application. Experiments performed so far have indicated that the invention can also be used for treating metal or plastic foil, for instance, as well as surfaces of steel plating, wood, etc. The treating agents may also be of vastly differing type. Accounts have been given here of treating surfaces with water and other liquids, colour solutions, friction reducers, size solutions and pigment dispersions. However, the invention is not limited to the use of these treating agents and can of course be used for other surface-treating agents such as synthetic polymers, waxes intended to give the surface treated specific properties such as resistance to corrosion, certain barrier properties, release properties, or to apply paint or glue.

As mentioned above a smooth coating can be obtained also when very small amounts of coating are used, especially when the degree of foaming is comparatively high. However, it has surprisingly been shown that a smooth coating also can be attained with very small amounts of coating and with a foam that is not so dry, i.e. a lower degree of foaming at higher web speeds. Thus, it has been shown feasible to obtain a smooth coating on different types of paper amounts of coating of about 1–2 g/m$^2$ when the speed of the paper web exceeds 100–150 m/min. As an example it is mentioned a coating of a sized printing paper corresponding to that described in Example 1 above, wherein a smooth coating was obtained in the speed range up to 800 m/min. The degree of foaming was 8 to 10 times and the amount of coating 1.5–2 g/m$^2$ on each surface.

I claim:

1. A method of treating a moving surface with a treating agent comprising the steps of:

delivering the treating agent through a passage of a container and in the form of a foam of an application zone adjacent the surface to be treated;

providing a region of reduced pressure and moving the foam between said moving surface and an extended surface of the container towards said region of reduced pressure, causing bubbles in the application zone and adjacent said surface to burst as they enter into the region of the pressure drop at a location upstream of the application zone, whereby said treating agent is applied to said moving surface; and allowing gas liberated from the burst bubbles to exit through an opening in the application zone.

2. A method according to claim 1 wherein the application zone is defined by an application chamber, one surface of which is bounded by a portion of the surface being treated, treating agent from burst bubbles of the foam is absorbed by said portion of said surface and gas released from the foam is removed via a mouth of the application chamber, further comprising the step of continuously moving said surface relative to said application zone.

3. A method according to claim 2, and further comprising the step of continuously supplying the foam to the application zone in a direction substantially opposite to the direction of movement of the surface to be treated relative to the application zone.

4. A method according to claim 2 further comprising the step of regulating the quantity of agent to be applied by adjusting the contact length between the foam and the surface to be treated.

5. A method according to claim 1, further comprising the step of delivering the foam to the application zone at a flow rate so that as foam bubbles burst on contact with the surface, the burst bubbles are replaced by new bubbles at the same time as the gas liberated from the burst bubbles is removed from the application zone.

6. A method according to claim 1 further comprising causing foamed treating agent within the application zone to perform a circular or turbulent movement.

7. A method according to claim 1 further comprising the step of adjusting the flow of foam supplied to the application zone so that the quantity of the treating agent it contains corresponds to the quantity of treating agent absorbed by the surface.

8. A method according to claim 7 wherein the quantity of treating agent in the foam applied corresponds to the intended quantity to be applied to said surface.

9. A method according to claim 1 further comprising regulating the flow rate of the foam by throttling the foam during its passage to the application zone.

10. A method according to claim 1 wherein the foam used has a volume of at least 8 times that of the liquid from which it is made.

* * * * *